United States Patent [19]

Münch et al.

[11] Patent Number: 4,616,609

[45] Date of Patent: Oct. 14, 1986

[54] OIL CIRCULATION CIRCUIT FOR INTERNAL COMBUSTION ENGINE, AND METHOD OF CIRCULATING LUBRICATING OIL

[76] Inventors: Otto Münch, Lindenweg 11, CH-5703 Seon; Thomas Schibli, Beatusstrasse 38, CH-3008 Bern, both of Switzerland

[21] Appl. No.: 749,577

[22] Filed: Jun. 27, 1985

[30] Foreign Application Priority Data

Jun. 29, 1984 [CH] Switzerland ..... 3135/84

[51] Int. Cl.[4] ..... F01M 1/00

[52] U.S. Cl. ..... 123/196 AB; 123/196 R; 184/106; 184/6

[58] Field of Search ..... 123/196 R, 196 AB; 184/106, 6

[56] References Cited

U.S. PATENT DOCUMENTS

| | | | |
|---|---|---|---|
| 2,575,877 | 11/1951 | Klier | 123/196 AB |
| 2,757,650 | 8/1956 | Holley | 123/196 AB |
| 3,590,955 | 7/1971 | Rau | 184/6 |
| 4,258,679 | 3/1981 | Leitermann | 123/196 AB |
| 4,270,497 | 6/1981 | Valerio | 184/106 |
| 4,296,716 | 10/1981 | Hofbauer et al. | 123/196 AB |

FOREIGN PATENT DOCUMENTS 2811144 10/1978 Fed. Rep. of Germany .

*Primary Examiner*—E. Rollins Cross

*Attorney, Agent, or Firm*—Frishauf, Holtz, Goodman & Woodward

[57] ABSTRACT

To control the viscosity of oil circulating in a forced-oil circulation path of an engine, oil is conducted to a receptacle located, for example, within the oil pan of the engine or in communication with the overflow outlet stub (14) of the oil pump (3), and oil is conducted from this intermediate receptacle, for example in form of a pan (6) in two parallel paths. One of the paths conducts the oil directly to the suction inlet of the pump after, however, having to overcome a static pressure, for example by flowing over an elevated weir, notch, or through an overpressure valve; the other path is through a flow resistance element (7), for example a constricted tube, a lamella package, or the like, and then to the cooling portion of the oil pan, remote from the suction inlet of the pump. If the oil is cold, little of the cold and hence high-viscosity oil can flow through the flow restriction path, and back-pressure will build up, so that oil can flow through the overflow, weir, or the like, directly to the pump inlet, for rapid heating by the operating temperature of the engine; as the oil thins, and the viscosity drops, more oil will flow through the oil flow resistance path. If the oil is excessively diluted, it will be rapidly closed, since no back-pressure will develop and all the oil will flow through the second path, and be cooled by the oil pan.

19 Claims, 22 Drawing Figures

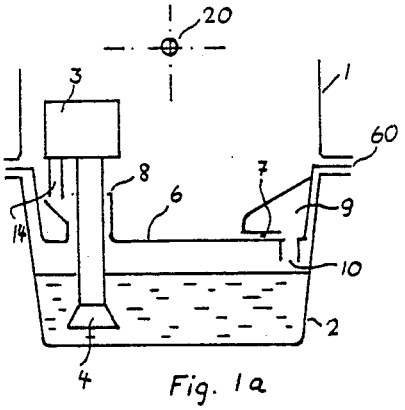
Fig. 1a
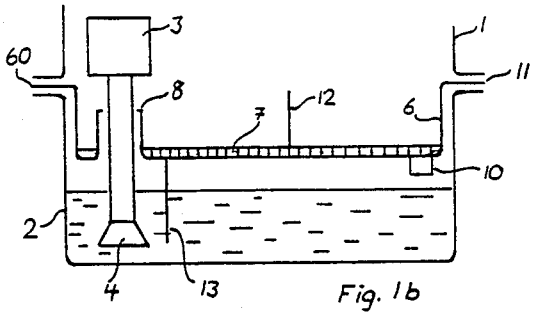
Fig. 1b
Fig. 1c
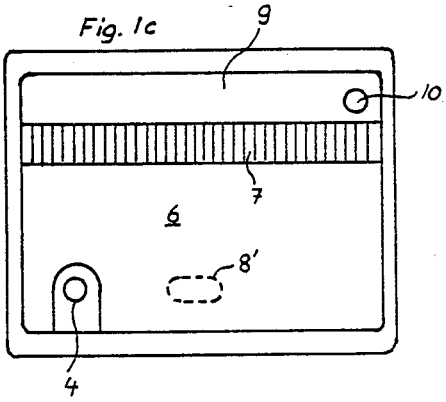
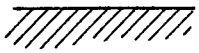
Fig. 2a
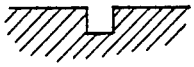
Fig. 2b
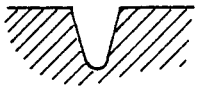
Fig 2c
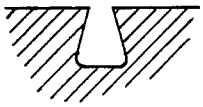
Fig 2d
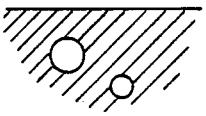
Fig 2e
Fig 4
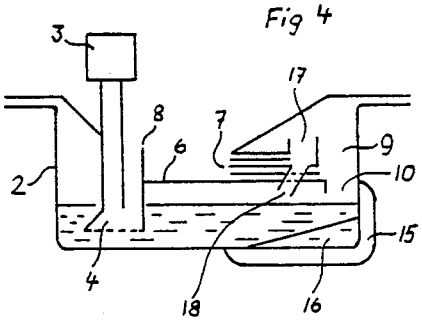

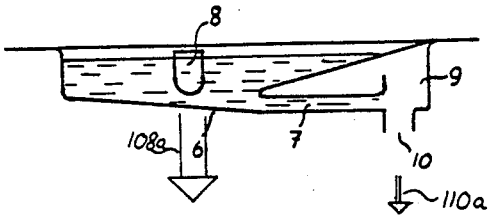
Fig. 3a
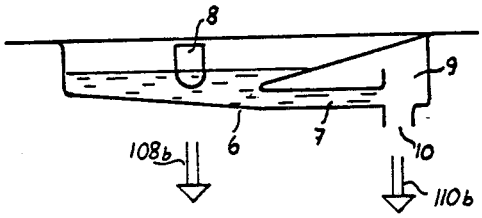
Fig. 3b
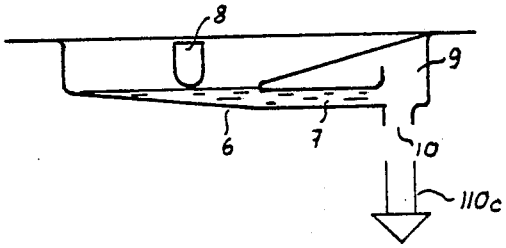
Fig. 3c
Fig. 5a
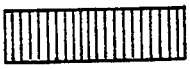
Fig. 5b
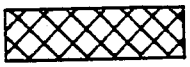
Fig. 5c
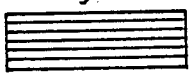
Fig 5d
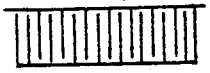

OIL CIRCULATION CIRCUIT FOR INTERNAL COMBUSTION ENGINE, AND METHOD OF CIRCULATING LUBRICATING OIL

The present invention relates to lubrication of internal combustion engines, and more particularly to a forced oil lubricating circuit, for use with automotive-type internal combustion engines, in which oil being circulated through the internal combustion engine both for cooling of bearings and piston rings operating in the cylinders is returned to an oil pan which is exposed to ambient temperature conditions, thereby cooling oil which had been circulating in the circuit.

BACKGROUND

Water-cooled automotive-type internal combustion engines (ICEs) usually have a forced pressure pump lubricating circuit, in which oil which has been passed through the engine for lubrication is cooled by being collected in an oil pan, forming an oil sump. The temperature of the cylinder walls of the engine, in water-cooled engines, is roughly uniform and counteracts excessive heating or cooling of the oil. For safety reasons, the oil temperature must be maintained at a value which is somewhat too low for optimum operation. Upon cold-starting an engine, particularly after a vehicle in which the engine has been installed has been parked outdoors in wintertime, and especially during a cold rain, the oil temperature is excessively low. Too low oil temperature results in excess use of fuel, which may reach several percent of excess fuel consumption, and, typically, is in the order of about 3% of excess. Such excessive fuel consumption is due entirely to excessively low lubricating oil temperature. In start-stop operation, and for short-distance runs, upon fractional loading of the engine, and poor environmental and weather conditions, the excess fuel required to overcome frictional losses due to increased oil viscosity rises above the foregoing average excessive values.

It has previously been proposed—see German Patent Disclosure Document DE-OS No. 28 11 144—to provide for thermostatic control of lubricating oil. Such thermostatic control has some disadvantages, however. The thermostatic lubricating oil control cannot be installed in existing engines without major modification; the thermostat has movable parts which may wear or malfunction, so that appropriate operation over the lifetime of the engine cannot be insured. Possible defects in the thermostatic control may not be noticed in time and, therefore, continuous lubrication by oil at excessively low temperature may result in damage to the engine. The arrangement is comparatively expensive in manufacture.

The technical basis on which the system of the referenced Disclosure Document No. 28 11 144 operates considers only temperature. Thus, if the engine has been exposed to extreme cold temperature, and is equipped with cold-temperature special oil, for example of the viscosity class SAE (Society of Automotive Engineers) 10W or 5W-20, the oil may reach dangerously low values of viscosity when thermostatically controlled. In such cases, thermostatic control of the oil is worse than none at all.

THE INVENTION

It is an object to improve lubrication of an internal combustion engine (ICE), and particularly to provide for a lubricating circuit, and for a method of lubrication, which is adapted to the viscosity of the oil.

Briefly, the oil, received from the engine or located within the engine in an oil sump or oil pan, is conducted to the oil pump over two parallel circuits. One of the circuits returns the oil to the pump close to the inlet thereof, the oil, however, having to overcome a static pressure level. In accordance with a feature of the invention, this can be easily accomplished by having the oil accumulate on an internal partition and permitting the oil to overflow through a controlled outlet at a level above the bottom of the partition, for example an orifice, a weir notch, or through a pressure-controlled outlet. The oil flow in that first circuit is directed close to the suction inlet of the customarily provided oil pump, so that it can be circulated and will be quickly heated due to operation of the engine. In parallel to this first path is a second one which, however, introduces or includes a flow resistance to the oil, so that oil which is cold, and hence of high viscosity, will not readily pass through the flow resistance. In accordance with a feature of the invention, this flow resistance is a controlled outlet, for example a thin tube, mesh or the like, which may extend from the collecting receptacle within the oil pan.

By controlling the flow in the second path, including the flow resistance, oil which is already heated can readily flow through the second path, be cooled in the oil pan, and returned to the inlet of the pump. This oil, that is, low viscosity oil, thus will be cooled before it will flow to the suction inlet of the pump.

Oil flowing in the pressurized circuit, thus, is effectively controlled to have a uniform viscosity. The system operates without movable parts and, in accordance with a feature of the invention, can be included in existing ICEs. The additional oil pan, which can be constructed in form of a baffle, can be used additionally to or in lieu of a gasket holding the oil pan in position. Thus, the system can be readily included with existing automotive vehicles, and constructed inexpensively since all that is required is a shaped metal element directing oil, respectively, either in the first path to the suction inlet of the oil pump via a pressure generating lip in which a weir or opening is formed or, selectively, through a flow resistance which may be a mesh opening, lamella, or the like, and then to the major area of the oil pan remote from the pump inlet.

Upon operation of the ICE for some time, that is, when the engine is hot and the oil temperature will be hot, the entire back flow will occur over or through the flow resistance path, thereby passing the oil through the oil pan for cooling the oil. The oil may not even need the entire cross section of the restricted path in which the flow resistance is included. As the engine ages, and oil circulation increases, the entire oil flow, even at the increased level, will be cooled at the given viscosity which permits oil to flow through the path.

As the oil circulation increases, the backflow or overflow from the pump will decrease. If the arrangement is so made that the backflow or overflow from the pump is also included in the recirculation path, the portion of the backflow oil will then increase as the engine ages, and therefore the cooled portion of the recirculated oil will increase. In such arrangements, the cross section of the resistance path or restricted path can be so designed that it is capable of passing, at low viscosity of the oil, the maximum pump throughput of which the pump is capable at high engine speeds. At lower engine speeds, a lesser quantity of oil will then flow primarily through the oil flow path which includes the resistance portion.

Slight increase in viscosity of the oil at low engine speeds, is desirable to obtain good lubrication of bearings and technically correct, since the frictional energy loss, as well as the load carrying capacity of the bearings decreases at lower speeds. The temperature of the oil which lubricates the cylinder walls is essentially determined by the temperature of the cylinder walls which, in turn, is essentially determined by the thermostatic setting of the cooling water.

It is possible to recirculate the return or overflow of the pump, which is only slightly heated, directly to the suction side of the pump or to connect a return or overflow stub from the pump back to the region of the suction inlet of the pump.

It is usually sufficient to conduct the oil which is returned from the engine, and hence has been heated, over a cooling surface formed by the oil pan itself, as soon as its temperature has reached the optimal value, or has exceeded the optimal value. An optimum value has, in the past, been considered to be about 80° C. Higher requirements on engines, with lower fuel consumption, has, however, led to recommendations to operate the oil at a higher temperature.

An internal return flow of the pump excess oil permits reaching the optimum temperature in a shorter period of time. It is possible to even further reduce the heating time of the oil when the system is integrated with the construction of the engine.

The flow resistance portion of the second path can be formed as a structure arranged transversely or longitudinally in the engine. Baffles or vanes, with small passage openings, can be provided, possibly covered at least in part in order to prevent the formation of waves in the oil reservoir and overflow when the oil is subjected to external forces in operation of the vehicle, for example upon sharp braking, acceleration, or passing through curves.

The flow resistance can be formed, for example, in the form of a lamella package, in which some of the lamellae can be made to be removable, so that the viscosity of the oil passing through this restricted flow resistance path defined by the lamellae can be set in accordance with design levels and, as the engine ages, some of the lamellae may be removed so that a lower temperature, or higher viscosity, respectively, can be used. Rather than using lamellae or ducts, the flow resistance element may be a wire mesh or the like. Wire mesh, although inexpensive, is not preferred, however, since wire mesh tends to be sensitive with respect to dirt or contamination. Aluminum is a suitable material for a separating element and/or flow resistance components.

All embodiments of the invention have the essential common characteristic that the quantity of oil which is applied to the cooling path, that is, to the second path, depends entirely on the viscosity of the oil and the static pressure to which it is subjected, e.g. the accumulation of oil necessary to flow over a weir or through a suitably placed opening or orifice in an auxiliary pan. The influence of the pressure due to the damming level can be modified or even eliminated if the flow resistance is designed to accept only a portion of the oil while, additionally, the cooling is enhanced over that of letting the oil accumulate and be cooled in the pan by providing additional heat exchange elements, for example an additional oil cooler or cooling fins or ribs. A separate return flow with reduced cooling may also be provided from the upper region of dammed or retained lubricant.

The flow resistance element preferably should be so constructed that flow will be laminar. This is not a requirement throughout the entire operating range, and, at extreme temperatures, turbulent flow is also acceptable.

DRAWINGS

FIG. 1, collectively, is a schematic sectional view of the arrangement, wherein FIG. 1*a* is a schematic side view of an embodiment illustrating a duct-type flow resistance;

FIG. 1*b* shows a flow resistance path with lamellae, and a separating baffle;

FIG. 1*c* is a top view of another embodiment;

FIG. 2, collectively, shows various arrangements of an overflow, weir, or orifice arrangement, wherein FIG. 2*a* illustrates a marginal portion of an auxiliary oil pan;

FIGS. 2*b*, 2*c* and 2*d* illustrate various configurations of notches to define a predetermined damming level;

FIG. 2*e* shows an orifice arrangement;

FIG. 3*a* is a schematic side view illustrating the operation when the oil is of high viscosity;

FIG. 3*b* illustrates the arrangement as the viscosity drops;

FIG. 3*c* illustrates the arrangement at low viscosity;

FIG. 5*a*, FIG. 5*b* and FIG. 5*d*, each, are cross-sectional views through different embodiment of flow resistance elements; and FIGS. 6 to 11 are schematic sectional side views illustrating various modifications and embodiments of the basic system shown in FIG. 1.

DETAILED DESCRIPTION

Figure 6:
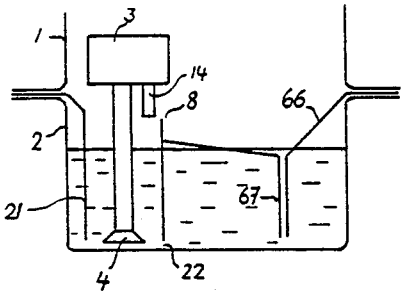

The lower portion of an engine block 1 of an automotivetype internal combustion engine (ICE) has attached to it by suitable attachments bolts—not shown—an oil pan 2. The crankshaft 20 is shown only schematically. A lubricating pump 3 has a suction inlet 4 which dips within the level of oil in the oil pan. The oil pan 2 receives the normal fill quantity of oil, shown only schematically. The space above the oil level is usually sufficient for installation of the apparatus in accordance with the present invention; in low-pan engine constructions, the embodiments shown in connection with FIGS. 6–11 are particularly suitable.

In accordance with the present invention, an intermediate or auxiliary pan 6 is provided which receives oil which has been circulated through the engine. The auxiliary pan 6 divides the oil, based on viscosity thereof, into two paths: one, via an overflow 8 which terminates close to the suction inlet 4 of the pump, and the other through a flow resistance path 7 which directs the oil into a path where it is subjected to cooling before reaching the suction inlet 4.

Oil of low viscosity can flow through the flow resistance 7 and then into a duct 9 and to an opening 10 from which it is directed into the engine oil pan 2. The lower surface of the engine oil pan 2 is exposed to ambient temperature, where the oil is cooled before it will reach the suction inlet 4 of the pump 3. The opening 10 is located at a position in the pan remote from the suction inlet 4. If the oil has high viscosity, that is, is still very thick and, for example, cold, it can flow through the flow resistance 7 only very slightly, and thus will collect in the pan 6 until it will flow over or through the overflow 8, where it will be applied directly, without cooling, to the suction inlet 4 of the pump 3.

Preferably, the auxiliary pan 6 is made of sheet aluminum, for example deep-drawn or stamped. The edges of the pan 6 are carried upwardly, and a ring-shaped or open-notched upstanding collar, through which the suction inlet stub connected to the suction inlet 4 of the pump 3 extends, is formed with the overflow 8.

The arrangement can readily be made for retrofitting or after-installation in existing engines. For such arrangements, that is, when the pump 3 is already in place, the pan 6 is so formed that the upstanding collar is laterally open. This may result in an interruption in the horizontally extending rim portion 60 of the pan, requiring a sealing or gasket insert for the interrupted portion. Absolute tightness of the pan 6 is not necessary, and the rim 60 can be secured also, by clamping, within the gasket, which is usually present, for the pan 2. If the suction inlet stub for the pump 3 can be screwed in from below, the collar defining the overflow 8 can be constructed as a closed, cylindrical structure. An edge portion 11, on one or both sides of the rim 60, can be suitably coated with gasket material, so that the rim 60 can take over the function of the oil pan seal.

One or more separating baffles or vanes 12 (see FIG. 1*b*) may extend upwardly from the pan 6 to prevent total overflow of oil from the pan 6, for example through or over the overflow 8, if the vehicle is subjected to sudden change in velocity or direction. A lower baffle wall 13 prevents intermixing of oil which is not to be cooled with the still cold oil in the oil pan. The baffles 12 can be secured to the pan 6 in any suitable manner, for example by adhesives. Of course, the separating wall 13 may, also, be secured to the oil pan 2.

Excess oil flowing through the pump 3 is only slightly heated therein. It is returned by a return stub 14 (FIG. 1*a*) to the region of the suction stub 4. Internal return of excess oil, pumped, for example, under high-speed operating conditions of the engine, would be even better.

Under certain conditions, return flow of oil from the pump into the pan 6 may be desirable. At present, oil pumps do not have constant volumetric output under widely varying different speeds of the pump. Consequently, the pump must be designed to provide the necessary oil lubrication under low engine speed conditions, e.g. under idling conditions, and the pump then must be so designed that the substantial excess oil being pumped thereby at high speeds can be returned to the oil reservoir. Such return may, for example, be over an additional return overflow 8' (FIG. 1*c*) which is directed to a position where the oil is only lightly cooled, for example in a median or central region of the oil pan 2—see FIG. 1*c*. The overflow 8, which defines the damming level of the oil in the auxiliary pan 6, and hence the static pressure therein, may have various shapes. For example, a straight-line weir edge—FIG. 2*a*—may be used; similarly, FIGS. 2*b*, 2*c* and 2*d* show notched walls or, alternatively, a solid wall with only one or several openings possibly of different sizes and at different levels—FIG. 2*e*—may be used. Flow through the openings shown, for example, in FIG. 2*e*, depends much more on the damming level of oil within the auxiliary pan 6 than on the viscosity, unless the openings are very small.

Any one of the overflow arrangements shown in FIGS. 2*a*–2*e* may be combined and used together; thus, a small opening (FIG. 2*e*) may be used in addition to an overflow notch (FIGS. 2*b*, 2*c*, 2*d*) and located at a position remote from the overflow notch, to provide for controlled oil flow; such an arrangement is particularly suitable for engines having more than usual or normal oil consumption.

Operation, with reference to FIG. 3 (collectively)

When the oil is cold, that is, highly viscous and heavy, laminar flow through the flow resistance 7 is very small, and practically nil, as shown by the small arrow 110*a*. The oil will accumulate in the auxiliary pan 6 and rise above the level of the overflow 8 and the major portion of oil flowing out from the pan 6 will be through the overflow 8, shown, schematically, as a rounded notch. The flow portion with highly viscous, heavy oil is shown by the large arrow 108*a*. This oil, being directed close to the suction inlet stub 4 of the pump 3, will not be subjected to cooling in the pan.

In operation, and as the oil temperature rises—which is accelerated by not cooling returned oil—the oil will become thinner or lighter, and the viscosity will drop. A much larger portion of the oil can now flow through the oil resistance path 7, as schematically indicated by arrow 110*b*; likewise, the oil which will back up in the auxiliary pan 6 and flow through the overflow 8 will be reduced—see arrow 108*b*. The oil stream 110*b* will be cooled in the oil pan 2.

The proportion of oil flowing through the overflow 8 or through the flow resistance path 7, respectively, will vary depending on the viscosity which, in the usual oils, is a function of temperature. Since this functional relationship is not necessarily linear, however, and the oil flow should be controlled based on viscosity, the system of the present invention provides for automatic adjustment of oil flow in accordance with optimum lubricating conditions for the engine.

The flow resistance path 7 and the overflow 8 are preferably so arranged and matched to each other that the oil viscosity and oil temperature will be an optimum for the operation of the engine.

When the oil viscosity drops below the desired or optimal level, it becomes very light and easily flowable, and then will flow practically entirely through the flow resistance path 7 which will provide little impediment to this light-flowing oil. This light-flowing oil, thus, will hardly back up or dam in the pan 6 behind the overflow 8 and all the oil will flow as shown schematically by arrow 110*c*. Consequently, all oil which flows back and is returned from the engine will be cooled by the pan in the path from the outlet 10 to the suction inlet 4 of the pump, before it is returned by the pump into the oil lubricating circuit.

The foregoing operation will occur under all conditions of the oil, and even if it is too thin, without having an excessively high temperature. Oils may have been introduced into the engine for use under conditions in which the engine is not being used—for example the engine may be supplied with Arctic oil, while, actually, it is not used under such conditions; further, oil may be diluted by mixing with fuel, and, thereby, reach an unduly low viscosity.

In any case, low-viscosity oil is additionally cooled; high-viscosity oil may, even at high temperatures, flow partially through the overflow 8. High-viscosity oil, such as SAE 50, may be in use, which has advantages for lubrication of piston rings and overall oil consumption of the engine, since the temperature of the oil for lubricating of the piston—cylinder system is essentially determined by the temperature of the cylinder wall, and hence the viscosity of the oil actually at the points to be lubricated is determined by engine temperature. For hydrodynamic lubrication of the bearings, however, the oil which is returned by the pump will be sufficiently hot, and hence of sufficiently low viscosity, so that no increased bearing friction will occur even though the oil in the pan is a high-viscosity oil.

The system is particularly suitable for drive trains in which the transmission is lubricated by engine oil. Transmissions, also, preferably use oil of higher viscosity.

In accordance with the invention, thus, the viscosity of the oil can be matched to that required for lubrication of the piston—cylinder arrangement and of the transmission, without increased tribological friction losses in the bearings by use of oil having a higher viscosity classification rating than that desirable for bearing lubrication if the oil lubricating the bearing had been cooled.

FIG. 4, schematically, shows how the system of the present invention can be integrated with the structure of an automotive-type ICE.

The overflow 8 opens directly into the suction inlet stub 4 of the pump. Consequently, the motor will receive pre-warmed oil in shortest period of time. Cooling fins 15, 16, located outside and inside of the oil pan 2', provide for effective and intensive cooling of oil which has passed through the flow resistance path 7. Since this cooling can be very intense, it is sufficient if only a fraction of the oil flowing back is being cooled. This permits reducing the influence of the damming level and the oil circulation quantity. A further reduction can be obtained by arranging the upper region of the flow resistance element, which is preferably laminar, to terminate in a separate duct 17 which is connected to an opening 18 directing oil into a region of the pan 2' intermediate the opening 10 and the inlet stub 4, so that oil passing through the stub 18 is only partially cooled.

FIG. 5, collectively, shows various arrangements of flow resistance elements. FIG. 5*a* shows a package of lamellae, which are vertically arranged. This arrangement has the least tendency for plugging or contamination. FIG. 5*b* illustrates an arrangement in which a mesh is used; the cross section may be diamond-shaped or honeycomb-shaped; a honeycomb duct arrangement may also be used. This permits control of flow to particularly low values of viscosity, that is, flow-through, essentially unimpeded, of only the lightest of oils. Other structures may be used, e.g. horizontal lamellae, see FIG. 5*c*. This arrangement is particularly suitable since the laminar flow resistance 7 can be easily matched to the damming level of the oil in the receptacle 6.

FIG. 5*d* illustrates an arrangement in which a portion of the lamellae is retained on a bottom element, and another portion on the top element. This permits removal of a portion of the lamellae, and thus matching the viscosity of oil which is to be cooled to special climatic conditions, or to change the oil flow rate of oil to be cooled as the engine ages. Thus, a higher viscosity for oil flow through the resistance 7, for older engines, may be obtained by removing a portion of the lamellae, so that the oil within the entire oil circuit will be at a cooler operating level. Such change in the operating characteristics of the oil circuit in the engine thus is possible without major invasion of the oil circuit as a whole.

The arrangements of FIGS. 1 (collectively) and 4 assume that sufficient free space is available above the level of the oil. In flat or compact engines, the cranks of the crankshaft operate only slightly over the normal oil level. In such arrangements, the embodiments of FIGS. 6 to 11 are particularly suitable.

Embodiment of FIG. 6: The auxiliary pan 66 is funnel-shaped and dips below the normal level of the oil in the pan 2. At the lowest point, the flow resistance 7 in the form of a narrow, vertical tube 67 is attached to the pan 66. The overflow 8 is formed by a tube 21 fitted into the pan 2, and terminating within the funnel-shaped auxiliary pan 66. The tube 21 is extended at the bottom towards the end of the suction inlet 4 of the pump, leaving, however, an opening 22 with respect to the bottom of the oil pan 2. The return flow stub 14 of the pump is directed into the tube 8, so that heated oil coming from the return flow 18 will hardly mix with the oil which is still cold, or has been cooled, and is located within the pan 2. Thus, oil being pumped is rapidly brought to operating temperature, and to the required low viscosity.

The embodiments of FIGS. 7 to 10 illustrate particularly compact constructions in which the depth of the pan need not be extended over that normally present in existing ICEs of the automotive type.

Figure 7:
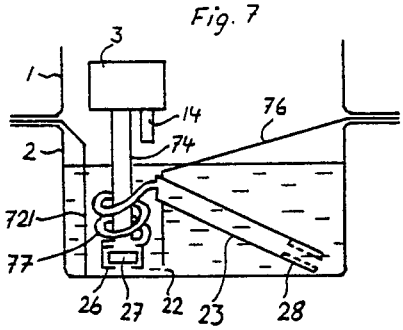

Embodiment of FIG. 7: The viscosity control system is arranged in the pump inlet suction system. The inlet stub 74 has a check valve 26, 27 located therein, which operates with a very low opening pressure, for example just under 0.1 bar. In closing direction, the valve element 27 is seated on an inwardly extending flange 26. The weight of the element 27 alone may be sufficient to close the valve in downward direction. A similarly located flange or radial fins above the flange 26, and spaced by more than the thickness of the element 27, limit the upward movement of the element 27, however without sealing it. A narrow tube 77, forming the laminar flow resistance 7, terminates in the inlet stub 74 above the valve 26, 27. The upper end of the tube 77 is connected to a tube 23 which may have an interior diameter substantially larger than the tube 77. The tube 23 is directed at its lower end towards a region of the pan 2 which is remote from the inlet stub 74 of the pump, in order to provide of oil flow from the outlet of tube 23 to the inlet stub 74. The auxiliary pan 6 is again formed in funnel shape, with a tubular extension 721 which reaches down to the bottom of the pan 2, but leaves open an opening 22, to provide communication from the interior of the funnel-shaped auxiliary pan 76 with the remainder of the oil pan 2.

Operation of the embodiment of FIG. 7

In operation of the engine, the oil which is sucked up through the tube 23 will rapidly reach the temperature of the return flow from the stub 14 of the oil, which also washes around the tube 77. The flow resistance of the tube 77 thus will change with the temperature of the oil being returned. At low oil temperature, only little oil will pass through the tube 77. The remainder is sucked up through the valve 26, 27. The oil included in the funnel-shaped auxiliary pan 76 will form only a minor portion of the entire oil in the pan. This minor portion will be heated rapidly, even when the engine is still cold, so that the oil will rapidly reach the optimum viscosity. As the temperature increases, the flow resistance offered by the tube 77 will decrease, and an increasing percentage of cooled oil will flow through the tube 23 from the lower right-hand end thereof and consequently through opening 22 to the cooled oil pan 2.

When the oil is hot, the check valve 26, 27 is closed, so that the entire oil flow will be cooled.

If desired, a further flow resistance element 28 can be included in the tube 23, so that the temperature of the cooler oil in the pan 2 can also be used to affect the oil flow through the tube 23.

Figure 8:
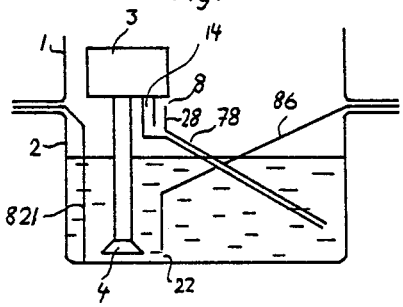
Figure 9:
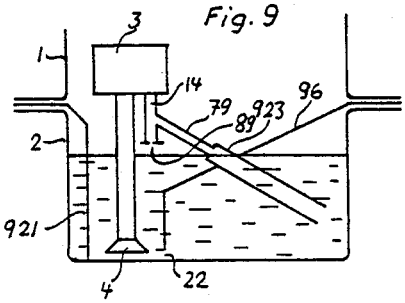
Figure 10:
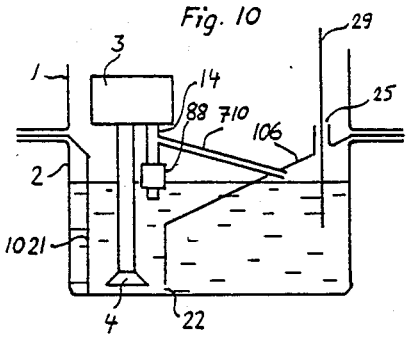

In the embodiments of FIGS. 8, 9, 10, the viscosity control of the oil in the circuit is located in the pump return or return flow circuit.

Automotive-type ICEs usually have volumetric oil pumps which are so arranged that the oil pressure and oil flow necessary for lubrication of bearings is already provided at lowest operating engine speed, typically at idling speed of the engine. Since the drive speed of the oil pump varies with variation in engine operating speed, a substantial portion of the oil which is pumped by the pump is bypassed directly from the pump to a pump return flow 14 back into the sump 2 when the engine is operating at road speed of the vehicle. Since the pump return oil has precisely the temperature and viscosity of the oil which is being applied to the lubrication points within the oil circuit, this oil is particularly suitable to also provide for viscosity control of all the oil being pumped.

The auxiliary pan is again of essentially funnel shape. The oil pans 86, 96, 106 of FIGS. 8, 9, 10, each, are fitted with a tube 821, 921, 1021, respectively, which, in each case, is extended down to the bottom of the pan 2, and formed with an opening 22 to permit oil in the pan to reach the inlet stub 4 of the pump 3.

In the embodiment of FIG. 8, the pump return flow is conducted into a receptacle 28 in which the oil is either directed by a tube 78 or a conduit of any cross section suitable for an appropriate flow resistance to a cooled region of the oil pan 2 or permitted to overflow by an overflow 8, for example over the edge of the receptacle 28, directly to the suction inlet stub 4 of the pump 3. The tube 78, which can be very narrow, may be made, in dependence on the temperature within the oil pan 2, either of good heat-conductive material, for example aluminum, or, if desired, of poorly heat-conductive material, for example plastic.

In operation, when the oil is warm, a greater percentage of the pump return quantity will flow through the tube 78 within the cooled region of the pan 2 and, being cooled thereby, then through the opening 22 in the suction inlet stub 4, than if the oil is cold or heavy. Thus, the oil within the funnel-shaped pan 86 is rapidly warmed to the desired operating temperature, and oil being supplied by the pump 3 to the oil circuit of the engine always will have, rapidly, the required consistency and viscosity.

The arrangement of FIG. 9 is similar, except that, instead of the overflow 8 from the receptacle 28, a constriction 89 is provided at the outlet of the return flow stub 14 from the pump. Since the flow resistance through the constriction or diaphragm 89 is practically independent of the viscosity, whereas the flow resistance through the resistance portion 7, defined by the tube 79, rises as a function of the heaviness or viscosity of the oil, the ratio of the oil supplied through the opening or diaphragm 89 directed to the inlet stub 4 with respect to the oil flowing through the resistance 7 defined by the tube 79, and then through the tube 23 to the cooled region of the pan 2, changes in the sense of reduction in variation of heaviness or viscosity of the oil. In the embodiment of FIG. 9, this relationship is relatively little dependent on the quantity or return flow supplied by the pump. The enlarged region of the tube, that is, tube 923, has the same function as that explained in connection with FIG. 7, namely that the relationship of flow being directly returned to the inlet stub 4 and flow being passed through the cooling portion of the pan 2 is essentially independent of the temperature of the cooling pan 2.

Independence can also be obtained by conducting the tube 79 directly to the pan above the normal oil level, and suitably controlling the return flow of the oil from the stub 14. FIG. 10 illustrates a return flow control by use of an over-pressure valve 88, which has the same operating effect as the overflow 8 in FIG. 8.

The air space above the oil level in the pan 2 must communicate with the air space above the auxiliary pan, and formed as the funnel 6 since, otherwise, pressure differences may build up above the auxiliary pan 6. Communication is automatically provided by an opening 25 in the pan collectively shown as pan 6 (pan 66, 76 . . . ) to permit insertion of a dip stick 29 to check oil level. Such an opening 25, for dip-stick measurement, would be provided in all the embodiments, but is only shown in FIG. 10 for simplicity of the drawing.

Figure 11:
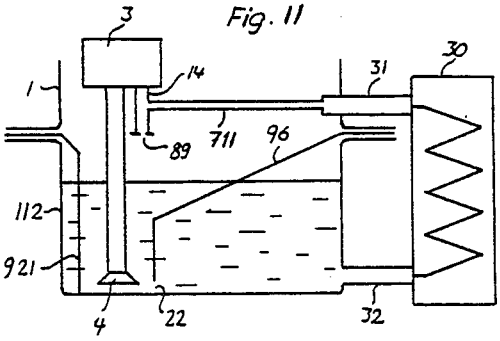

The system may also be used with an external lubricating oil cooler. FIG. 11 illustrates an external cooler 30 which is coupled by pipes 31, 32 on the one hand to the outlet overflow stub 14 of the pump 3 and, on the other, to the bottom of the oil pan 112, corresponding to the pan 2, and connected at a position remote from the suction inlet stub 4. A laminar flow resistance formed by a tube 711 is coupled in the oil cooling circuit including the external cooler 30. In all other respects, the arrangement is similar to that described in connection with FIG. 9. The direct outlet from stub 14 to the inlet 4 of the pump is constricted, for example, by diaphragm opening 89.

Various changes and modifications may be made, and features described in connection with any one of the embodiments may be used with any of the others, within the scope of the inventive concept.

We claim:

1. In combination with an internal combustion engine, a forced-oil circulation circuit including an oil pump (3) having a suction inlet (4), and means (2, 30) for cooling oil circulating in the forced-flow circuit, comprising, in accordance with the invention, means for controlling cooling of oil circulating in the forced-oil flow circulation circuit as a function of viscosity of the oil being circulated by the pump (3) including means (6, 28) for receiving oil;

a first controlled outlet (8, 89, 88) from the oil receiving means directing oil to the suction inlet (4) of the pump;

and a second outlet (9, 23, 32) including means (7, 67, 77, 78, 79, 710, 711) for introducing resistance to the flow of oil through the second outlet, wherein the resistance is a function of the viscosity of the oil, the second outlet directing oil to the oil cooling means (2, 30), said oil cooling means being in flow communication with the suction inlet (4) of the pump.

2. Oil circulation circuit according to claim 1, wherein said second outlet is positioned below the first outlet.

3. Oil circulation circuit according to claim 1, wherein the first outlet includes an over-pressure valve (88) permitting flow therethrough when the pressure thereagainst exceeds a predetermined level.

4. Oil circulation circuit according to claim 1, wherein the first controlled outlet comprises a damming means and an overflow (8).

5. Oil circulation circuit according to claim 1, wherein the first controlled outlet comprises a damming means an orifice or diaphragm therein .

6. Oil circulation circuit according to claim 1, wherein the first controlled outlet comprises an over-pressure valve (88).

7. Oil circulation circuit according to claim 1, wherein the means for cooling the oil circulating in the forced-flow circuit comprises an engine oil pan (2);

the oil pump (3) includes an oil recirculating or return outlet (14);

said second outlet being positioned in a path of oil from the return outlet to the pan, and having a downstream end terminating in a cooled region of the pan, said first outlet having a downstream end terminating adjacent the suction inlet (4) of the pump.

8. Oil circulation circuit according to claim 7, wherein the pan is located beneath an engine block (1) of the internal combustion engine; the means for receiving the oil comprises an auxiliary pan (6) and said first controlled outlet comprises an outflow region at a level above the bottom of the auxiliary pan, the auxiliary pan being located at a level above the bottom of the pan (2) forming part of the engine.

9. Oil circulation circuit according to claim 1, wherein the means for introducing flow resistance from the second outlet comprises means defining at least one restricted duct.

10. Oil circulation circuit according to claim 9, wherein said at least one restricted duct comprises a package of lamellae.

11. Oil circulation circuit according to claim 1, wherein the means for introducing flow resistance comprises at least one tube of restricted diameter, offering flow resistance to oil having a viscosity above that required for lubrication of the engine.

12. Oil circulation circuit according to claim 1, wherein a plurality of second outlets are provided directing oil to positions of the oil cooling means of different cooling capacity.

13. Oil circulation circuit according to claim 1, further including a baffle (12, 13) located in at least one of:

said means for cooling the oil (2);

said means for receiving the oil (6) to prevent mixing of oil which is not to be cooled with cooled oil.

14. Oil circulation circuit according to claim 1, further including means (21) separating the oil cooling means (2) to define a chamber therein, said chamber being formed with means (22) for communicating with the remainder of said oil cooling means.

15. Oil circulation circuit according to claim 14, wherein the oil pump includes an oil recirculation or return line (14);

the oil receiving means directs at least a major portion of the oil from the recirculating or return line (14) of the pump into said chamber;

an overpressure valve is located in the suction inlet (4) of the pump and communicates with said chamber;

and the means for introducing resistance interconnects the remainder of said oil cooling means and the suction inlet of the pump downstream of said overpressure valve.

16. Oil circulation circuit according to claim 8, wherein the pump includes an oil recirculating or return line (14); and means for receiving oil being connected to receive oil from the overflow or recirculating line of the pump.

17. Oil circulation circuit according to claim 1, wherein the means for cooling oil circulating in the forced-flow circuit comprises an oil pan (2), said means for receiving oil comprises an auxiliary pan (6) located at a level above the bottom of the oil pan;

and means (25) providing air communication between the lower and upper sides of the auxiliary pan, said means comprising a dip-stick opening to, simultaneously, permit checking the level of oil in said pan (2).

18. In an internal combustion engine having a forced-flow oil circulation circuit, including an oil pump (3) having a suction inlet (4) and means (2, 30) for cooling oil circulating in the forced-flow circuit, a method of controlling oil flow in the oil circulating circuit as a function of the viscosity of the oil, comprising directing oil flow in two parallel paths to the suction inlet of the pump;

establishing a static oil pressure level;

permitting flow of oil in a first one of said paths when the oil has a static pressure in excess of said static oil pressure level, and directing oil flow to the suction inlet of the pump essentially without cooling of the oil; and controlling the flow in a second path as a function of the viscosity of the oil and cooling the oil as it is being directed in said second path to the suction inlet of the pump, whereby, when the oil is hot and hence of low viscosity, the oil can flow through the second path without having to overcome the pressure level of the static pressure but, when the oil is cold and of high viscosity, oil flow through the second path will be restricted and, upon overcoming said static pressure level, will be directed to the pump suction inlet through the first path, and without cooling.

19. Method according to claim 18, including the step of conducting the oil flow in said second path through a flow restriction element (7) which permits flow without essential build-up of back-pressure ahead of the flow restriction element only upon viscosity of the oil at a low level suitable for engine lubrication and, upon build-up of said back-pressure, thereby generating said static pressure which is overcome upon oil flow in said first path directly to the suction inlet of the pump, and without cooling.

* * * * *